US005235345A

United States Patent [19]

Ohno et al.

[11] Patent Number: 5,235,345

[45] Date of Patent: Aug. 10, 1993

[54] IMAGE RECORDING APPARATUS FOR THERMALLY RECORDING IMAGES ON A THERMAL-SENSITIVE MEDIUM

[75] Inventors: Tadayoshi Ohno, Kawasaki; Takashi Yamaguchi, Yokohama; Shinichi Itoh, Kawasaki, all of Japan

[73] Assignee: Kabushiki Kaisha Toshiba, Kawasaki, Japan

[21] Appl. No.: 770,472

[22] Filed: Oct. 3, 1991

[30] Foreign Application Priority Data

Oct. 4, 1990 [JP] Japan ..... 2-264986

[51] Int. Cl.[5] ..... B41J 2/365

[52] U.S. Cl. ..... 346/76 PH; 346/140 R; 346/108

[58] Field of Search ..... 346/76 PH, 140 R, 108

[56] References Cited

U.S. PATENT DOCUMENTS

| | | | |
|---|---|---|---|
| 4,376,942 | 3/1983 | Toth et al. | 346/76 PH |
| 4,827,286 | 5/1989 | Sukigara et al. | 346/76 PH |
| 4,870,428 | 9/1989 | Kuwabara et al. | 346/76 PH |
| 5,025,267 | 6/1991 | Schofield et al. | 346/76 PH |

FOREIGN PATENT DOCUMENTS

| | | |
|---|---|---|
| 52-55831 | 5/1977 | Japan . |
| 61-15469 | 1/1986 | Japan . |

*Primary Examiner*—Benjamin R. Fuller
*Assistant Examiner*—N. Le
*Attorney, Agent, or Firm*—Cushman, Darby & Cushman

[57] ABSTRACT

An apparatus for recording an image, based on a pixel signal which has an on-mode or an off-mode signal, on a recording medium. The image is recorded by applying a threshold energy level, wherein the apparatus records a visible image if the pixel signal has the on-mode signal and does not record a visible image if the pixel signal has the off-mode signal. The apparatus includes a thermal head for recording the image, based on a first pixel signal, a second pixel signal and a third pixel signal, on the recording medium by applying the threshold energy level sequentially; a control circuit for generating first reference data in response to the mode of the second pixel signal and second reference data in response to the mode of the third pixel signal when the thermal head records the image based on the first pixel signal; and a driving circuit for controlling an energy level applied by the thermal head being below the threshold energy level, based on the combination of the first reference data and the second reference data generated by the control circuit when the thermal head records the image based on the first pixel signal which has the off-mode signal.

5 Claims, 5 Drawing Sheets

FIG. 3(a)
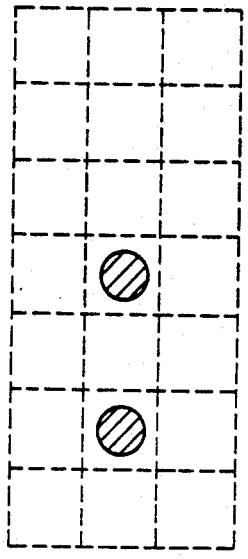
FIG. 3(b)
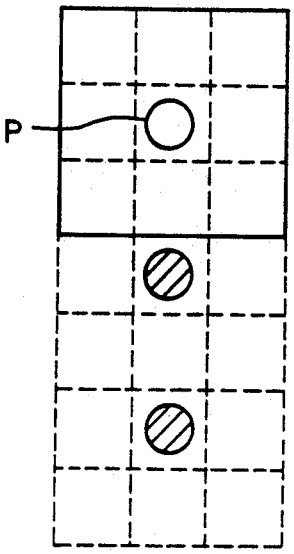
FIG. 3(c)
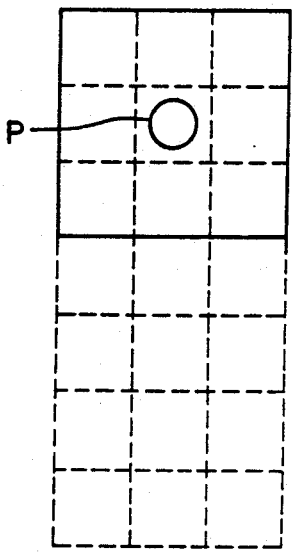
FIG. 4(a)
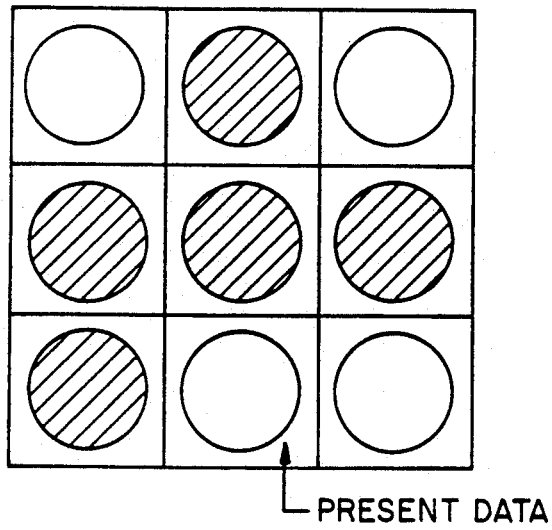
FIG. 4(b)
| | | |
|---|---|---|
| M : −0.3<br>S : −0.1 | M : −0.8<br>S : −0.4 | M : −0.3<br>S : −0.1 |
| M : −0.5<br>S : −0.3 | M : −1.0<br>S : −0.5 | M : −0.5<br>S : −0.3 |
| M : −0.8<br>S : −0.4 | M : 8<br>S : 5 | M : −0.8<br>S : −0.4 |
PRESENT DATA FIG. 6(a)
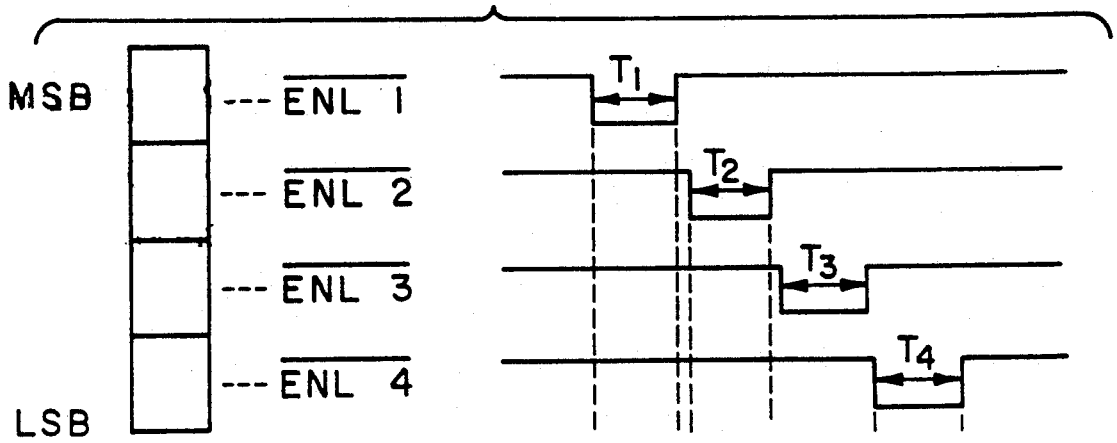
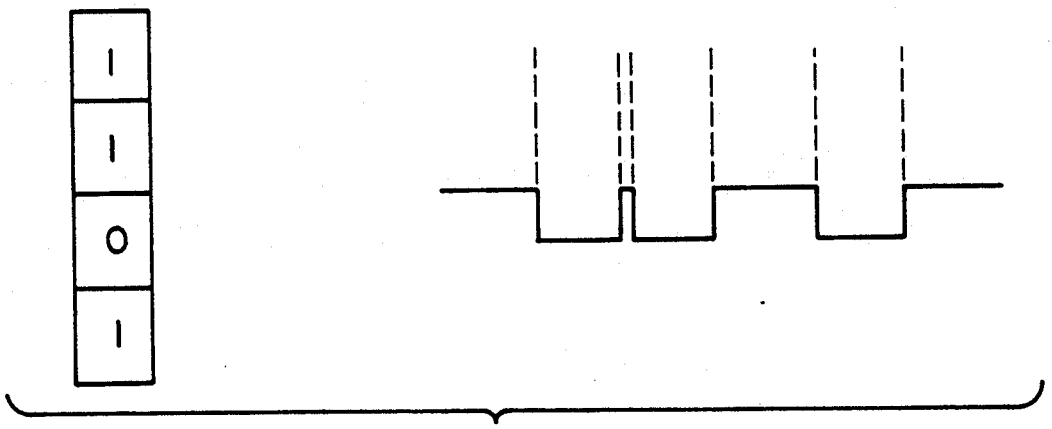
FIG. 6(b)

IMAGE RECORDING APPARATUS FOR THERMALLY RECORDING IMAGES ON A THERMAL-SENSITIVE MEDIUM

FIELD OF THE INVENTION

The present invention relates generally to an image recording apparatus, and more particularly, to an image recording apparatus which thermally record images on a thermal sensitive image recording medium.

BACKGROUND OF THE INVENTION

Recently, prepaid cards which store information of prepaid money have been used in many fields, e.g., vending machines, traffic toll collecting machines, etc. These machines for dealing such prepaid cards generally accommodate an image recording apparatus which record images such as characters and/or figures on the prepaid card for visualizing information of the balance registered therein.

Conventionally, several recording systems, such as a magnetic recording system, a thermal recording system, a mechanical punch recording system, etc. are used for the image recording apparatus to the prepaid card. Recently, however, the thermal image recording apparatus has been increasingly used from reasons of easiness and convenience for use. To a reliability for use of the prepaid cards, these image recording apparatus including the thermal image recording apparatus must have a sufficient durability against various stimulative causes such as light, heat, magnetic flux, mechanical wear, etc. from the external environmental conditions.

In the thermal image recording apparatus, the prepaid cards are provided with a metal film as an image recording layer from a reason of security. At present, a tin film is widely used for the prepaid cards. The tin has approximately a melting point 236° C.

In a recording operation for the metal film such as the tin film, a thermal head of the thermal image recording apparatus heats portions of the metal film over the melting point so that the melted portions are dissipated out from the prepaid cards. Generally the metal film such as the tin film has a relatively low sensitivity in comparison to thermosensitive ink which is adopted in thermosensitive recording paper and the like. Thus the thermal image recording apparatus for prepaid cards require high recording power for obtaining images comparable to the thermosensitive recording paper.

When recording images continuously on the metal film, a temperature of the thermal head varies at a start and an end of the recording operation, because a heat accumulated in the thermal head is gradually dissipated. Thus, for example, it is often difficult to keep a uniform density in all marks image when they are recorded.

Further, if it is attempted to record one dot mark at a location widely spaced from adjacent past and future marks, the recording of one dot mark would be failed because the temperature of the heating resistor could not instantly exceed a threshold level of temperature required for melting the metal film.

In order to prevent such defects, a thermal image recording apparatus incorporating a heat accumulation control for the thermal head has been disclosed.

An example of a system of conventional heat accumulation controls is disclosed in the Japanese Patent Disclosure (Kokai) No. 61-15469. This heat accumulation control system disclosed in the Japanese Patent Application relates to image recording to the thermosensitive recording paper, but not to metal recording media such as prepaied cards.

In this heat accumulation control system adopted in the conventional thermal image recording apparatus, a heating energy required for recording images on a particular line is calculated in reference to information of recorded images on one or more past lines. Then a required pulse width of heating current supplied to the thermal head is determined.

This conventional heat accumulation control system is advantageous to the image recording operation for the thermosensitive recording paper, but is not sufficient for the metal recording media. That is, the conventional heat accumulation control system is adapted to control energy for recording medium with a relatively low threshold level of printing image. For example, the thermosensitive recording paper and a thermosensitive ink ribbon for thermal printers have a threshold image printing level of about 60° to 80° C.

For example, no heating current is supplied to the present recording area if space data (i.e., data not causing of image printing) continue long in that area, while heating current is applied for a longer time to mark data (i.e., data for causing of printing image) appearing in following such a long space data in comparison to a mark data within a continuing mark data.

However, if this conventional heat accumulation control system were applied to low sensitivity image recording media such as metal films, it is necessary to extend extremely longer the time for applying a recording current to the heating resistor.

Therefore, when shifting from continuous space data to mark data, a recording current applied to the heating resistor and a thermal stress caused by the recording current disadvantageously exceed respective tolerance limits for the heating resistor. This results that the thermal head would be worn out rapidly.

SUMMARY OF THE INVENTION

It is, therefore, an object of the present invention to provide an image recording apparatus which is able to stably record any image without distinction of its position in relation to other images.

Another object of the present invention is to provide an image recording apparatus suitable for recording images on low sensitivity image recording media such as metal films.

In order to solve the problem described above, the image recording apparatus according to the present invention includes a thermal head for recording the image based on a first pixel signal, a second pixel signal and a third pixel signal on the recording medium by applying the predetermined energy source, sequentially; a control circuit for generating first reference data in response to the level of the second pixel signal and second reference data in response to the level of the third pixel signal when the thermal head records the image based on the first pixel signal; and a driving circuit for controlling an energy source applied by the thermal head lying below the predetermined energy source based on the combination of the first reference data and the second reference data generated by the control circuit when the thermal head records the image based on the first pixel signal which has the non-active level on the recording medium.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 3A-3C are diagrams showing a reference area used in the explanation of FIG. 2;

FIGS. 4A-4B are matrix diagrams for illustrating an example of the weighting of the referencing image area;

FIGS. 6A-6B are diagrams showing the relation between control data and resulting recording pulses generated by the control data.

DESCRIPTION OF THE PREFERRED EMBODIMENTS

Figure 1:
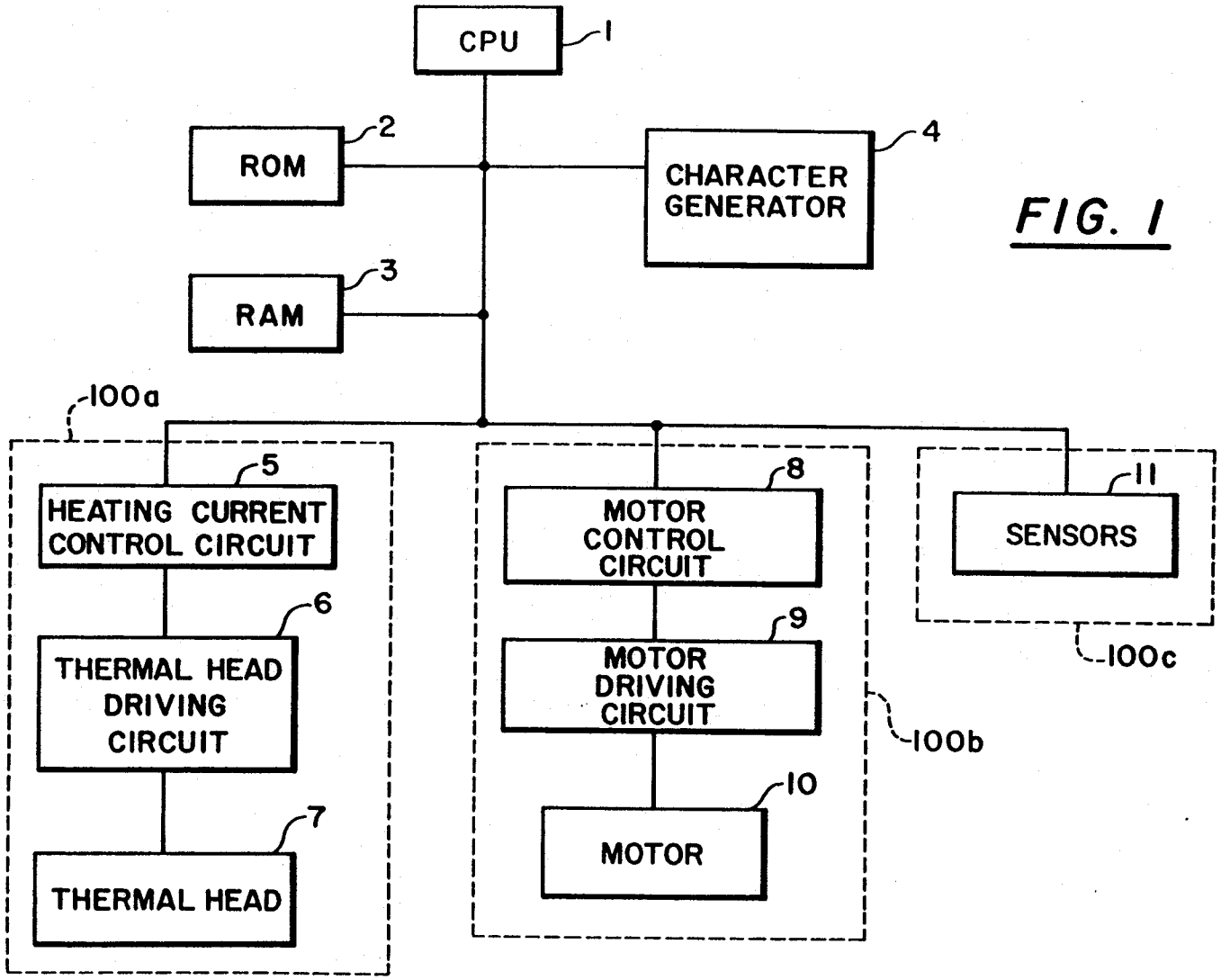
FIG. 1 is a block diagram showing an embodiment of image recording apparatus according to the present invention.

The present invention will be described in detail with reference to FIGS. 1 through 6. Throughout the drawings, like or equivalent reference numerals or letters will be used to designate like or equivalent elements for simplicity of explanation.

Referring now to FIG. 1, an embodiment of the image recording apparatus according to the present invention will be described in detail. FIG. 1 shows a block diagram of the embodiment of image recording apparatus. In this diagram, the image recording apparatus has a main controller including a CPU (central processing unit) 1, a ROM (read only memory) 2, a RAM (random access memory) 3 and a character generator 4. The CPU 1 is electrically coupled to control all the other components, i.e., the ROM 2, the RAM 3, the character generator 4 and the image recorder 100.

The image recorder 100 includes a recording section 100*a*, a transporting section 100*b* and a sensing section 100*c*. The recording section 100*a* includes a heating currents control circuit 5, a thermal head driving circuit 6 and a thermal head 7. The heating currents control circuit 5 determines an input energy for applying to the thermal head 7 in response to a signal transferred from a CPU 1 according to an image to be recorded. The thermal head driving circuit 6 produces a drive voltage for driving the thermal head 7 according to an input energy determined by the heating currents control circuit 5. The thermal head 7 records an image on a recording medium according to the drive voltage produced by the thermal head driving circuit 6. The thermal head 7 generally comprises a plurality of heating resistors (not shown).

Calculations of pulse widths of the heating currents for preheating the thermal head 7 and for substantially heating a recording medium through the thermal head 7 are carried out by the heating currents control circuit 5 in reference to pixel data within a predetermined image area. The image area includes past pixel data and future pixel data, as well as the present pixel data. Then a required pulse width of the current for preheating or substantially heating the thermal head 7 is determined by suitably estimating a heat accumulation on the thermal head 7 from the calculation. That is, the heating currents control circuit 5 carries out a determination of the pulse width of the heating current for recording the dot mark on the recording medium in reference to the past pixel data, an estimation of the amount of heat accumulation of the thermal head 7 for the present pixel in reference to future pixel data, and a determination of the pulse width of the heating current for preheating the thermal head 7 in reference to the future pixel data in response to the present space dot.

The transporting unit 100*b* includes a motor control circuit 8, a motor driving circuit 9 and a motor 10.

Figure 2:
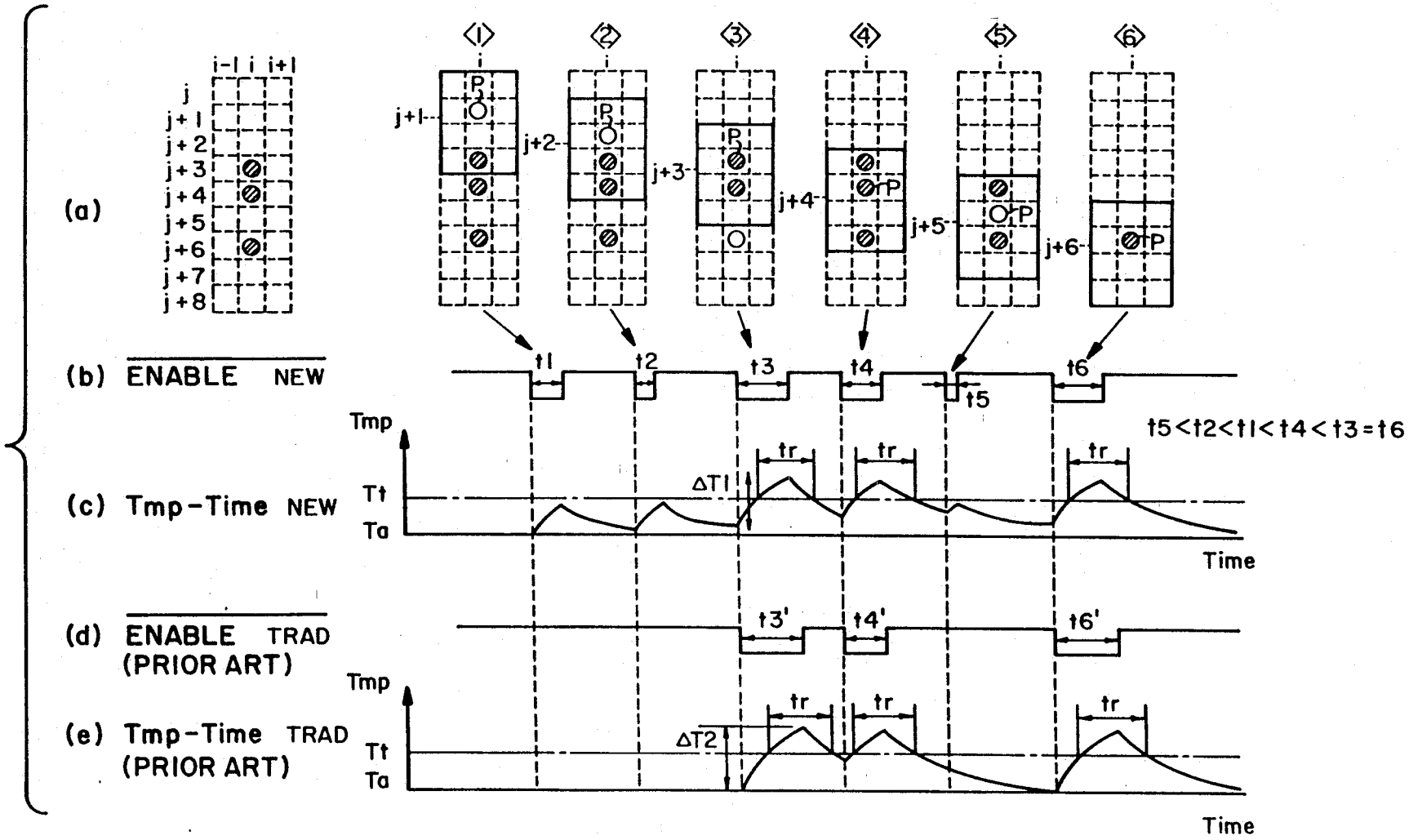
FIGS. 2A-2E are timing diagrams for explaining pulses of recording currents to be applied to a thermal head according to the present invention.

Referring now to FIG. 2, an image recording operation carried out by the image recording apparatus of FIG. 1 will be described below.

Image data (pixel data) have been stored in the RAM 3. The pixel data is successively transferred from the RAM 3 to the heating currents control circuit 5 in response to a recording request. In the heating currents control circuit 5, the pulse width of image data in a line is determined in reference to past image data and future image data line by line as described above. The pulse width data and image data of the present line are transferred to the thermal head driving circuit 6. This thermal head driving circuit 6 drives the thermal head 7 by interpreting the pulse width data applied from the heating currents control circuit 5 to cause the thermal head 7 the image recording operation.

Now, a manner for determining a pulse width of heating current for the present pixel according to image data pattern is explained. FIG. 2(*a*) shows an image area including a set of successive image data, i.e., mark dots to be recorded and space dot not to be recorded. FIGS. 2(*b*) and 2(*c*) show timing charts between the pulses and temperature change of heating resistors in the thermal head 7 in the image recording apparatus according to the present invention. FIGS. 2(*d*) and 2(*e*) show those in the conventional image recording apparatus described in the section, "BACKGROUND OF THE INVENTION".

In FIGS. 2(*b*) and 2(*d*), t1 through t6 and t3' through t6' represent pulse widths. In FIGS. 2(*c*) and 2(*d*), Ta shows an ambient temperature, Tt shows a threshold temperature necessary to generate an image on an image recording media, tr represents a time length exceeding the threshold temperature Tt, $\Delta T1$ and $\Delta T2$ represent temperature rises necessary for generating image on the image recording media. A predetermined image area with $3\times4$ matrix (reference matrix) as shown by the solid line frame in a time sequence from an instant of <1> through an instant of <5> in FIG. 2 is provided for determining the pulse width of heating currents for the present pixel data. The image area comprises past one line and future two lines, as well as present one line.

As to the instant of <1> in FIG. 2, when in reference to the coordinates in FIG. 2(*a*), it is seen that the present pixel P(j+1, i) is a space dot and a mark dot is located only in the position (j+3, i) on the second future line of the the same row to present pixel P(j+1, i). The image recording apparatus of the present invention calculates a pulse width of the heating current to be applied to the thermal head 7 in reference to the past line image data in the reference matrix at the instant of <1>, and in reference to the pulse width of heating current and further in reference to that the present line is a space dot but the a mark dot exists in the second future line to the present pixel P(j+1, i). In this instant, the thermal head control circuit 5 generates a relatively short pulse with a pulse width t1 for preheating the thermal head 7 so that the temperature of the thermal head 7 rises but below the threshold temperature Tt.

At the instant of <2> in FIG. 2 in which now the present pixel P(j+2, i) is also another space dot, but two mark dots present in the next two lines, i.e., the first and second future lines in the same row to the present pixel P(j+2, i). In this instant, in reference to that two mark dots exist in the next two lines so that images will be recorded successively in the next two lines, a very short pulse with a pulse width t2 is applied for slightly preheating the thermal head 7 in reference to the heat accumulation remaining from the preheating at the instant of <1>. The pulse width t2 is calculated in reference to an amount of heat discharged between the instants of <1> and <2>. The pulse width t2 is shorter than the pulse width t1 so that the temperature of the thermal head 7 rises but still below the threshold temperature Tt.

Here, as shown in FIGS. 2(*d*) and 2(*e*), the conventional image recording apparatus no pulse was applied to the thermal head 7 at the instants of <1> and <2> because the conventional image recording apparatus did not refer to future image data.

At the instant of <3> in FIG. 2 in which now the present pixel P(j+3, i) is a mark dot, and another mark dot exists in the first future line, but the second future line is a space dot. In this instant, a pulse width t3 of the heating current is calculated in reference to the present and past lines in the reference matrix but without referring to the future lines. The pulse width t3 has a relatively long so that the temperature of the thermal head 7 rises sufficiently above the threshold temperature Tt. Thus, the actual image recording for the mark dot in the pixel P(j+3, i) is performed onto a recording medium. The heating of the thermal head 7 aboe the threshold temperature Tt lasts for the predetermined time length tr.

On the conventional image recording apparatus, it was necessary to generate a pulse with the extremely long pulse width t3' in comparison to the pulse width t3 in the present invention because the temperature of the thermal head 7 must be raised the temperature rise ΔT2 from the ambient temperature Ta, to get the time length tr necessary to the actual image recording.

While in case of the image recording apparatus according to the present invention, the thermal head 7 has been preheated in the past instants of <1> and <2>. Thus, the temperature rise ΔT1 necessary to the actual image recording operation at the instant of <3> is able to start from the remaining heat according to the heat accumulations in the past instants of <1> and <2> so that the temperature rise ΔT1 is advantageously reduced form the temperature rise ΔT2 (ΔT1<ΔT2). This is also effective to reduce the thermal stress against the thermal head 7 because the temperature changing rate per time in the small temperature rise ΔT1 is also less than that in the large temperature rise ΔT2.

At the instant of <4> in FIG. 2 in which now the present pixel P(j+4, i) is another mark dot appearing in succession to the mark dot of the past pixel P(j+3, i), but still another mark dot is located in the position (j+6, i) in the second future line of the the same row to present pixel P(j+3, i). In this instant, a pulse width t4 of the heating current is also calculated in reference to the present and past lines in the reference matrix but without referring to the future lines. As the past line had the mark dot, the pulse width t4 is reduced shorter than the pulse width t3 in reference to the remaining heat of the thermal head 7 from the previous actual image recording operation. However, the heating of the thermal head 7 above the threshold temperature Tt is also able to last for the predetermined time length tr in similar to the heating at the instant of <3>. This is effective to prevent the temperatue of the thermal head 7 uncontrollably exceeding an abnormal temperature damaging the thermal head 7.

At the instant of <5> in FIG. 2 in which now the present pixel P(j+5, i) is another space dot, but a mark dot presents in the next line, i.e., the first future line in the same row to the present pixel P(j+5, i), while the second future line being another space dot. In this instant, in reference to that a mark dot exists in the first future line so that an image will be recorded in the first future line and also in reference to that a relatively large amount of heat remains in the thermal head 7 due to the heating for the actual image recording operation in the past instant of <4>, an extremely short pulse with the pulse width t5 is applied for a little preheating the thermal head 7. The pulse width t5 is also calculated in reference to an amount of heat discharged between the instants of <4> and <5>. The pulse width t5 is shorter than the pulse width t2 because the remaining heat from the instant of <4> is higher than the remaining heat from the instant of <1>. So that the temperature of the thermal head 7 rises but below the threshold temperature Tt.

At the instant of <6> in FIG. 2 in which now the present pixel P(j+6, i) is a mark dot, but no mark dot appears in the present image area except the mark dot of the present pixel P(j+6, i) In this instant, a pulse width t6 of the heating current is also calculated in reference to the present and past lines in the reference matrix but without referring to the future lines. The pulse width t6 has a relatively long in similar to the pulse width t3 in the past instant of <3> so that the temperature of the thermal head 7 rises sufficiently above the threshold temperature Tt. Thus, the actual image recording for the mark dot in the pixel P(j+6, i) is performed onto the recording medium. The heating of the thermal head 7 above the threshold temperature Tt also lasts for the predetermined time length tr.

Now, the relations between the pulse widths of the preheating current regarding the space data and the states of the pixel in the reference matrix, will be summarized in below.

(1) If a mark dot does not exist on the present line but exists in future lines in the present image area with a predetermined matrix such as the reference matrix, the pulse width of the heating current is decided so that the temperature of the thermal head 7 rises but below the threshold value Tt.

(2) The pulse width is decided in reference to image data of the past and the present lines in the present image area, wherein:

(2a) if larger the number of mark dots, the pulse width is reduced shorter;

(2b) if mark dots are condensed closely to each other, the pulse width is reduced shorter; and (3) if no mark dot exists in the future lines in the present image area, no pulse is applied.

Now in referring to FIG. 3, the reason for referring to the future two lines in the present invention will be described below. In FIG. 3, it is assumed that a space dot and a mark dot alternate with each other in the same row, as shown in FIG. 3(*a*). If an image area is set to a 3×3 matrix with the solid line frame, as shown in FIGS. 3(*b*) and 3(*c*), for referring to only one future line, it is impossible to detect such an alternation of the space dots and the mark dots. That is, in FIG. 3(*a*), the present image data is a mark dot, and the future image data in the image area is a space dot. In this instant, another mark dot in the second future line from the present image data can not be referred for determining a pulse width to record the image of the present data. Thus, the image area can not distinguish the image pattern of FIG. 3(*b*) from the image pattern, as shown in FIG. 3(*c*), wherein space dots continue. Thus, it is impossible to minimize the thermal stress against the thermal head 7 by suppressing the temperature change rate per time in the thermal head 7.

In the above description, a case where future pixels to be refered for determining the pulse width for recording the image of the present pixel exist in the same row to the present pixels. However, it is understood that even when a mark dot does not exist in the same row to the present pixel but exists on other rows in the 3×3 matrix, it is possible to perform the preheating control by the same operation as described above.

The pulse width of heating current may be calculated by weighting mark dots according to their positions in relation to the present pixels in the referencing image area. FIG. 4 shows matrix diagrams for illustrating an example of the weighting of the referencing image area. FIG. 4(*a*) is an example of the referencing image area with a 3×3 matrix. In the referencing image area of FIG. 4(*a*), black circles represent mark dots while white circles represent space dots. A weighting table, as shown in FIG. 4(*b*), having also 3×3 matrix in correspondence to the referencing image area of FIG. 4(*a*) is provided in a ROM. The weighting table includes 3×3 coefficients each corresponding to the data of the referencing image area of FIG. 4(*a*).

In the referencing image area of FIG. 4(*a*), the bottom center segment is associated with the present dot now given by a space dot. The bottom center segment of the weighting table now corresponding to the present dot of the referencing image area is provided with a weighting coefficient of 8 for mark dot (M) or a weighting coefficient of 5 for space dot (S). The weighting coefficients 8 and 5 are adapted for determining basic pulse widths of heating current applied in response to the mark dot and the space dot. Other segments of the weighting table are provided with other weighting coefficients as shown in FIG. 4(*b*). In these weighting coefficients, the larger the weighting coefficient with the minus symbol "—", the heat accumulation in the corresponding dot in the referencing image area goes larger. Then, the basic pulse widths are modified by the coefficients on the other segments in the table for reflecting the future images or the past images, as described before.

Figures 5A, 5B:
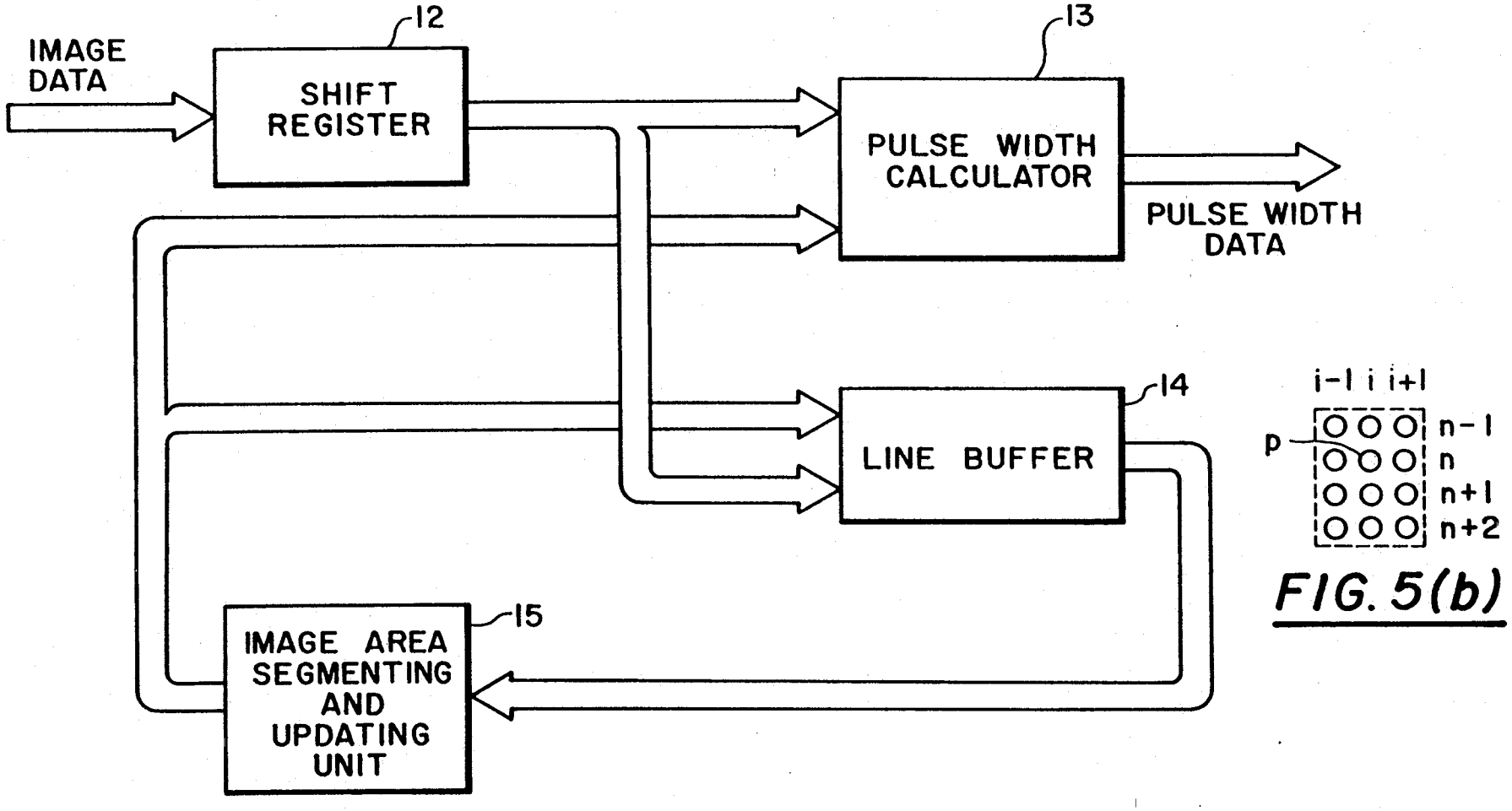
FIGS. 5A-5B are block diagrams showing the thermal control circuit 5 of FIG. 1 in detail.

Referring now to FIG. 5, the heating currents control circuit 5 will be described below in detail. FIG. 5(*a*) shows the block diagram of the heating currents control circuit 5 which carries out a calculation of a pulse width of heating current to be applied to the thermal head 7 for recording image of the present pixel in reference to the past pixel data, an estimation of the amount of heat accumulation in the thermal head 7 in reference to the future pixel data, and an optimization of a pulse width of preheating current with minimum energy lower than recording energy to record image in reference to the past and future images.

This heating currents control circuit 5 includes a shift register 12, a pulse width calculator 13, a line buffer 14, and an image area segmenting and updating unit 15. Now, setting an image area for a referencing operation as shown in FIG. 5(*b*), a manner for determining a pulse width for recording image of present pixels P(n, i) will be explained hereinafter.

For referring the image data on the past n−1 line and the future n+1 and n+2 lines to record the present n line, the line buffer 14 is adapted to have a capacity for storing the three lines. The image data of the n−1, n and n+1 lines has been transferred into the line buffer 14 in advance to the n+2 line. The present n line is recorded when the image data of the future n+2 line is transferred into the line buffer 14.

The 1st, 2nd, . . . , i−1th, ith, i+1th, . . . image data in the n+2 line are transferred serially to the shift register 12 from the RAM 3 (see FIG. 1). At this time, the shift register 12 takes out image data near the present pixel P by performing a serial-parallel conversion on this n+2 line image data. These image data are input to the pulse width calculator 13. At this time, the image data of the n−1, n and n+1 lines which have been transferred in advance to the lines now being transferred have been stored in the line buffer 14.

The image area segmenting and updating unit 15 segments an image area for referencing past and future image data around the present image data form image data stored in the line buffer 14. The image area segmented by the image area segmenting and updating unit 15 is transferred into the pulse width calculator 13, and at the same time the image data of the n−1 line stored in the line buffer 14 is successively updated by the image data of the n+3 line incoming into the image area segmenting and updating unit 15. In the pulse width calculator 13, the pulse width of the heating current for recording image of the present pixel P is calculated from the i−1th, ith and i+1th image data of the n−1, n and n+1 lines transferred from the image area segmenting and updating unit 15 and the i−1th, ith and i+1th image data of the n+2 line transferred from the shift register 12, and outputs pulse width data. The pulse width calculator 13 includes a ROM which stores a look-up table on which the image data patterns and the pulse width data are related to each other.

FIG. 6 shows the relation between pulse width data decided by the pulse width calculator 13 and pulse width to be applied to the thermal head 7. In this embodiment, these pulse width data expressed in 4 bit data each of which corresponds to ENL1, ENL2, ENL3 or ENL4 is able to generate sixteen kinds of apply pulse trains by combining them. For example, if "1101" pulse width data is input, ENL1, ENL2 and ENL4 are selected but ENL3 is not selected so that the apply pulse train will become as shown in FIG. 6(*b*). As explained above, the pulse width is controlled by combination of basic pulses.

As described above, the image recording apparatus according to the present invention is capable of performing the clear 1 dot line printing requiring large recording energy on image recording media having high durability and a high threshold value of recording sensitivity and the printing with stabilized quality from start to end of the recording.

Furthermore, the image recording apparatus is also capable of reducing energy applied for the heating resistors of the thermal head 7 and relieving thermal stress, etc. generated on the thermal head 7, and thus, extending service life of the heating resistor.

As described above, the present invention can provide an extremely preferable image recording apparatus.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. An apparatus for thermally recording an image on a recording medium comprising:

a thermal head for recording said image on said recording medium based on a first pixel signal, a second pixel signal and a third pixel signal, wherein said first pixel signal represents a present signal, said second pixel signal represents a signal subsequent to said first pixel signal and said third pixel signal represents a signal subsequent to said second pixel signal, said thermal head recording a visible mark on said recording medium when more than a threshold energy level is applied to said recording medium, each said pixel signal having either an on-mode signal or an off-mode signal, wherein recording occurs only if said pixel signal is in said on-mode;

a control circuit for generating a first reference data in response to said mode of said second pixel signal and a second reference data in response to said mode of said third pixel signal when said thermal head operates based on said first pixel signal; and a driving circuit for positively energizing said thermal head to a level below said threshold energy level based on said first reference data and said second reference data generated by said control circuit when said thermal head operates based on said first pixel signal having said off-mode signal.

2. The apparatus according to claim 1, wherein said first reference data and said second reference data each energize said thermal head with different respective energy levels based on a combination of said modes of said second and third pixel signals, wherein each of said different respective energy levels is below said threshold energy level.

3. An apparatus for thermally recording an image on a recording medium comprising:

a thermal head for recording said image on said recording medium based on a first pixel signal, a second pixel signal, a third pixel signal and a fourth pixel signal, wherein said second pixel signal represents a present signal, said first signal represents a signal preceding said second pixel signal, said third pixel signal represents a signal subsequent to said second pixel signal and said fourth pixel signal represents a signal subsequent to said third pixel signal, said thermal head recording a visible mark on said recording medium when more than a threshold energy level is applied to said recording medium, each said pixel signal having either an on-mode signal or an off-mode signal, wherein recording occurs only if said pixel signal is in said on-mode;

a control circuit for generating a first reference data in response to said mode of said first pixel signal, a second reference data in response to said mode of said third pixel signal and a third reference data in response to said mode of said fourth pixel signal when said thermal head operates based on said second pixel signal; and a driving circuit for positively energizing said thermal head to a level below said threshold energy level based on said first reference data, said second reference data and said third reference data generated by said control circuit when said thermal head operates based on said second pixel signal having said off-mode signal.

4. The apparatus according to claim 3, wherein said first reference data, said second reference data and said third reference data each energize said thermal head with different respective energy levels based on a combination of said modes of said first, third and fourth pixel signals, wherein each of said different respective energy levels is below said threshold energy level.

5. An apparatus for thermally recording an image on a recording medium comprising:

a thermal head for recording said image on said recording medium based on a first pixel signal, a second pixel signal and a third pixel signal, wherein said second pixel signal represents a signal subsequent to said first pixel signal and said third pixel signal represents a signal subsequent to said second pixel signal, said thermal head recording a visible mark on said recording medium when more than a threshold energy level is applied to said recording medium, each said pixel signal having either an on-mode signal or an off-mode signal, wherein recording occurs only if said pixel signal is in said on-mode;

a control circuit for generating a first reference data, when said second pixel signal is in said off-mode and said third pixel signal is in said on-mode, and a second reference data, when said second pixel signal is in said on-mode and said third pixel signal is in said on-mode or said off-mode, when said thermal head operates based on said first pixel signal; and a driving circuit for positively energizing said thermal head with a first energy level below said threshold energy level based on said first reference data and with a second energy level below said threshold energy level based on said second reference data, wherein said first energy level is higher than said second energy level, when said thermal head operates based on said first pixel signal having said off-mode signal.

* * * * *